US006585407B2

(12) United States Patent
Koch

(10) Patent No.: US 6,585,407 B2
(45) Date of Patent: Jul. 1, 2003

(54) STATIC MIXING ELEMENT, SINGLE STAGE STATIC MIXING ELEMENT SEGMENT, STATIC MIXER, MIXING VANES ELEMENT AND METHOD FOR MIXING VERY VISCOUS POLYURETHANE WITH A CURING ACCELERATING AGENT

(75) Inventor: Reto Koch, Oberrohrdorf (CH)

(73) Assignee: Sika Schweiz AG, Zurich (CH)

( * ) Notice: Subject to any disclaimer, the term of this patent is extended or adjusted under 35 U.S.C. 154(b) by 97 days.

(21) Appl. No.: 09/842,847

(22) Filed: Apr. 27, 2001

(65) Prior Publication Data

US 2002/0001257 A1 Jan. 3, 2002

(30) Foreign Application Priority Data

Apr. 27, 2000 (CH) ..... 830/00

(51) Int. Cl.[7] ..... B01F 5/06
(52) U.S. Cl. ..... 366/336; 366/337; 366/341
(58) Field of Search ..... 366/336, 337, 366/338, 339, 340, 341

(56) References Cited

U.S. PATENT DOCUMENTS

| | | | | |
|---|---|---|---|---|
| 3,923,288 A | * | 12/1975 | King | 366/336 |
| 4,316,673 A | | 2/1982 | Speer | |
| 4,522,504 A | | 6/1985 | Greverath | |
| 5,145,256 A | * | 9/1992 | Wiemers et al. | 366/336 |
| 5,605,400 A | * | 2/1997 | Kojima | 366/339 |
| 6,109,781 A | | 8/2000 | Ogasawara et al. | |

FOREIGN PATENT DOCUMENTS

| | | |
|---|---|---|
| CA | 2120356 | 3/1994 |
| DE | 1807922 | 6/1969 |
| DE | 2262016 | 6/1974 |
| DE | 3208462 | 9/1983 |
| EP | 2236621 | 2/1974 |
| EP | 0084180 | 7/1983 |
| FR | 2311577 | 12/1976 |
| GB | 1530386 | 10/1978 |
| JP | 58020225 | 2/1983 |
| JP | 05049887 | 3/1993 |
| SU | 1710110 A1 | 2/1992 |
| WO | WO9405412 | 3/1994 |

* cited by examiner

*Primary Examiner*—Joseph Drodge
(74) *Attorney, Agent, or Firm*—Burns, Doane, Swecker & Mathis, L.L.P.

(57) ABSTRACT

The present invention concerns a static mixing element (1) having a mixing channel (2) of substantially tubular shape which is undivided in axial direction and swirl vanes (4*a*, 4A, 4*b*, 4B) which are arranged beside each other and axially one after another in said mixing channel (2) and which radially abut on the inner wall of said mixing channel (2) and are, in this area, interconnected with said inner wall. Even in case of mixing very viscous components resp. mixing components at high flow rates, in which cases the forces applied by the flowing components to the swirl vanes (4*a*, 4A, 4*b*, 4B) are quite huge, the correct axial position of the swirl vanes, in particular in the entry area of the mixing element (1), can be assured. Especially for long mixing elements (1), this leads, under the before mentioned conditions, to a considerable improvement in mixing quality.

18 Claims, 11 Drawing Sheets

STATIC MIXING ELEMENT, SINGLE STAGE STATIC MIXING ELEMENT SEGMENT, STATIC MIXER, MIXING VANES ELEMENT AND METHOD FOR MIXING VERY VISCOUS POLYURETHANE WITH A CURING ACCELERATING AGENT

CROSS REFERENCE TO RELATED APPLICATIONS

This application claims the priority of the Swiss patent application No. 830/00 filed on Apr. 27, 2000, the disclosure of which is incorporated herein by reference in its entirely.

BACKGROUND OF THE INVENTION

The present invention relates to static mixing elements and to single stage static mixing element segments having a tubular mixing channel with mixing vanes arranged in that channel. Furthermore the present invention relates to static mixers with static mixing elements and/or single stage static mixing element segments of the before mentioned type, to a mixing vanes element for arrangement in a tubular mixing channel and to a method for mixing very viscous goods, in particular very viscous polyurethane with a curing accelerating agent.

Generally, static mixing elements resp. static mixers are used in applications where two or more streams of free-flowing goods have to be mixed to one substantially homogeneous stream. In the field of adhesives, there are known disposable static mixers for two component adhesive systems which consist of a plastics tube forming a mixing channel and, arranged in lose manner inside that tube, a one-piece mixing unit made of plastics whose mixing vanes are designed as swirl vanes. In the center, said mixing vanes are interconnected with each other in such way that they form a coherent mixing vanes element. Inside said tube, said mixing vanes element abuts, in the area of the exit of said tube, with its mixing vanes which are arranged in flow direction axial at the last position on an axial shoulder of the tube and thereby is, axially in flow direction, supported.

While this mixer design yields good results when mixing low viscous goods at low to medium flow rates, the results when mixing very viscous materials resp. at high flow rates are not satisfactory.

BRIEF SUMMARY OF THE INVENTION

Hence, it is a general object of the invention to provide static mixing elements, single stage static mixing element segments, static mixers, a mixing vanes element and a method for mixing very viscous goods, in particular very viscous polyurethane with a curing accelerating agent, which do not have the before mentioned disadvantages and can be manufactured or performed at low costs.

A first aspect of the invention concerns a static mixing element for mixing at least two components, comprising a mixing channel of substantially tubular shape which is undivided in axial direction and is formed by at least two separate radial segments and wherein an inner wall of said mixing channel in radial direction forms an outer boundary of a cross section for receiving said components and mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected with said inner wall for transferring axial forces to said mixing channel.

Thus, mixing channel and mixing vanes are formed by separate elements and one or more mixing vanes which are arranged on a position not being, in flow direction, the last axial vane position are interconnected with said inner wall for transferring forces which act in axial direction from said vanes to the inner wall of said mixing channel. This interconnection, which can be established by positive locking, by frictional connection, by glueing or welding or by a combination thereof, effects a stabilization of the axial position of the mixing vanes in the entry area of the mixing element.

As has been mentioned earlier, the inner wall of the mixing channels forms the outer boundary of the cross section of the mixing channel through which the components flow when they pass through the mixing element for being mixed. It encloses this flow path and is, with a large area, in contact with this stream of components. The inner contour of the mixing channel is tubular and preferably of substantially round, preferably of circular cross section. Substantially round cross section means a cross sections with a shape which prevents the formation of dead corners, like e.g. oval cross sections or cross sections of a polygonal shape that approximate a round, oval or similar cross section.

In case a non-round cross section is chosen, a mixing element can be provided in which, when using a uniform swirl vane distribution, the flow is alternately accelerated and decelerated. This can be of advantage in certain applications. Beside the before mentioned shapes of the cross section of the mixing channel it is also planned to use mixing channels with substantially angular and preferably square cross sections. Especially in case the mixing vanes in the mixing channel are simple turbulence vanes oriented transversely to the flow direction of the mixing element, such a cross section can be advantageous.

A mixing channel which in undivided in axial direction is a mixing channel whose inner wall is formed at a given radial position over its entire axial extension by a one-piece element. This means in other words that this mixing channel might be formed by several radial segments each extending over its entire length, but, however, not by several axial segments.

Preferably, the mixing channel is formed by exactly two radial segments each forming one half of said channel.

A second aspect of the invention concerns a static mixing element for mixing at least two components comprising a mixing channel of substantially tubular shape and of a, in axial direction, substantially constant cross section which is formed by a one-piece element and wherein an inner wall of said mixing channel in radial direction forms an outer boundary of a cross section for receiving said components and mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected by positive locking and/or frictional connection with said inner wall for transferring axial forces to said mixing channel.

A third aspect of the invention concerns a static mixing element for mixing at least two components comprising a mixing channel of substantially tubular shape which is formed by a one-piece element and wherein an inner wall of said mixing channel in radial direction forms an outer boundary of a cross section for receiving said components and mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected by positive locking through penetration of protrusions in recesses with said inner wall for transferring axial forces to said mixing channel.

In a preferred embodiment of one of the preceding three aspects, the mixing vane or the mixing vanes which are arranged in flow direction axial at the first position, or, in other words which are located at the entry of the mixing channel as such, are interconnected with the inner wall of the mixing channel. Surprisingly it has been found that stabilising the axial position of the mixing vanes in the area where the vanes abut on the inner wall, and especially in the entrance of the flow channel formed by the mixing vanes, leads to a substantial improvement of the mixing results when mixing very viscous goods, e.g. pasty materials, or goods at high flow rates. Since it appears that the correct axial position of the mixing vanes, especially in the entry area, is of utmost importance for the mixing result, the advantages of the invention best become apparent at extremely long mixing elements which have a multitude of mixing vanes arranged in axial direction one after another. At such mixing elements, the possible wrong positioning in axial direction of the mixing vanes which are arranged in flow direction at the first position due to a deformation of the mixing vanes element caused by forces applied to the vanes by the flow of goods passing through the mixing element is relative huge.

In a further preferred embodiment of one of the preceding three aspects, at least two mixing vanes which are in axial direction arranged one after another are, in an area in which they radially abut on the inner wall of the mixing channel, interconnected with said inner wall. Since these mixings vanes are directly supported in axial direction by the mixing channel, a stable mixer geometry, even in cases where relative big forces are applied to the mixing vanes, is achieved. Furthermore it is of advantage for the stability if, in addition, the mixing vanes which are arranged in axial direction one after another and/or which are arranged at the same axial position are interconnected with each other. Especially in case they are interconnected in an area near the center of the mixing channel, in combination with the interconnection of the mixing vanes with the inner wall of the mixing channel, dimensionally extremely stable mixing elements result.

Preferably, at least two mixing vanes form a coherent mixing vanes element. This is, by advantage, achieved by a common one-piece design of the mixing vanes. In this case, a mixing element results which has a simple construction and is composed of only a few components that can be manufactured in a cost effective manner. However, it is also planned to stick together or to glue or weld together individual mixing vanes to a mixing vanes element. A mixing vanes element can e.g. consist of at least two mixing vanes which are arranged at the same axial position, however it is preferred if it comprises at least two mixing vanes which are in axial direction arranged one after another and are, for example, interconnected with each other in the center of said element.

Also preferred are embodiments of one of the preceding three aspects at which mixing vanes of the mixing vanes element, which are arranged in axial direction one after another, are interconnected with each other, in an area which abuts on the inner wall of the mixing channel, through supporting pillars. This interconnection can e.g. be effected by a one-piece design in which the interconnected mixing vanes and the pillars are formed by a single element. However, there are also embodiments planned having individual pillars affixed between the mixing vanes or having mixing vanes comprising pillar-like portions that axially abut on each other for supporting each other.

A further preferred embodiment of the mixing element of one of the preceding three aspects comprises at least two such mixing vanes elements, which are preferably arranged axially one after another in the mixing channel. However, it is also foreseen to arrange individual mixing vanes elements beside each other in the mixing channel or to use a combination of both arrangements.

In the described way, it is possible to compose, from only a few standardised mixing vanes elements, static mixing elements of various length resp. with different numbers of mixing stages and to overcome problems in the manufacturing of mixing vanes elements.

In a preferred embodiment of one of the preceding three aspects, the mixing vane or the mixing vanes which are interconnected with the inner wall of the mixing channel resp. the mixing vanes element or the mixing vanes elements is or are interconnected with the mixing channel in axial direction through positive locking. By advantage, this is achieved through a penetration of protrusions formed by the mixing vanes or the mixing vanes element and/or the inner wall of the mixing channels into recesses formed by said mixing vanes or said mixing vanes element and/or said inner wall. Preferably, the mixing vanes which are interconnected with the inner wall radially protrude into one or several recesses in the inner wall of the mixing channel, thereby creating a positive locking situation axially in flow direction between said mixing vanes and said inner wall of said mixing channel. Furthermore, it is preferred if said recesses have substantially the shape of said mixing vanes in said area where said mixing vanes protrude into said recesses.

Furthermore, the positive locking situation between the mixing vanes resp. the mixing vanes element and the inner wall of the mixing channel can be achieved by adapting the outer contour of the mixing vanes or of the mixing vanes element and the contour of the inner wall of the mixing channel in such way that they together form a bayonet connection or a threaded connection, that protrusions snap-in into recesses or that additional elements like e.g. radial pins can effect a positive locking. In case mixing vanes elements are used whose mixing vanes are, in an outer area of said mixing vanes element, interconnected with each other by supporting pillars, it is foreseen that said pillars are arranged in recesses in the inner wall of the mixing channel. This is, in particular, reasonable in case these supporting pillars comprise means for causing an axial positive locking situation with said mixing channel.

In yet another preferred embodiment of one of the preceding three aspects, the mixing vane or the mixing vanes which are interconnected with the inner wall of the mixing channel resp. the mixing vanes element or the mixing vanes elements is or are in axial direction frictionally connected with the mixing channel, e.g through clamping. Also combinations of positive locking and frictional connection are planned, like e.g. mixing vanes elements having resilient vanes made of sheet steel. These elements can, under resilient slanting of said mixing vanes, be inserted, against flow direction, into a mixing channel e.g. made of plastics, and straddle against the inner wall of the mixing channel, after being properly positioned, upon being loaded through the forces applied to the vanes by the flow of goods through the mixing channel. With increasing axial forces in flow direction, the straddling forces increase as well, causing the sharp-edged steel vanes to interlock in said relative soft inner wall of said mixing channel.

Preferably, the mixing vanes are designed as swirl vanes, i.e. they are designed in such way that goods which have to be mixed are, in the area that is influenced by them, caused to turn around an axis of the mixing channel. In particular, it is preferred that swirl vanes which are arranged axially one after another have opposite swirl directions.

It is understood that other, not explicitly mentioned combinations like e.g. the use of supporting pillars in the area where the mixing vanes element abuts on the inner wall of the mixing channel together with a glue or welding connection of the same with the inner wall and/or together with a positive locking connection in axial direction with the mixing channel also are possible.

A fourth aspect of the invention concerns a static mixing element for mixing at least two components comprising a mixing channel of substantially tubular shape which is undivided in axial direction and is formed by at least two separate radial segments and wherein an inner wall of said mixing channel in radial direction forms an outer boundary of a cross section for receiving said components and mixing vanes arranged in said mixing channel which radially abut on said inner wall of said mixing channel and which are one-piece with at least one of said radial segments and wherein at least two of said mixing vanes are axially arranged one after another and wherein said mixing vanes of at least one of said radial segments preside over a split plane which is defined by radial split seams formed by said radial segment.

By such a design, it is for example possible to obtain an overlap of the radial extensions of the mixing vanes of two mixing channel segments which each form one half of the mixing channel.

The cross section of the mixing channel can have the same shapes as the one of the static mixing elements according to the preceding aspects.

In a preferred embodiment, the mixing channel is formed by two radial segments which each form one half of said mixing channel and which preferably comprise at least two mixing vanes each.

In another preferred embodiment, the mixing vanes which are in axial direction arranged one after another and/or which are arranged at the same axial position are interconnected with each others for transferring forces to each other which act in axial direction. This interconnection preferably is established in a central area of the mixing channel. In case it is desired to interconnect the mixing vanes of an individual radial segment of the mixing channel which are arranged axially one after another, it is preferred to interconnect these vanes in the area of the center of the mixing channel through a one-piece design, e.g. by forming them as one piece together with a central pillar. In case it is desired to interconnect the mixing vanes of at least two radial segments of the mixing channel with each other, it preferred to interconnect them in the area of the center of the mixing channel by generating a positive locking situation, e.g. in the fashion of intersecting teeth of two combs which are formed by the tips of the mixing vanes of said radial segments.

In yet another preferred embodiment of this static mixing element, the mixing vanes are designed as swirl vanes wherein it is preferred that swirl vanes which are arranged axially one after another have opposite swirl directions. Furthermore it is preferred to manufacture said static mixing element from plastics, preferably by injection moulding.

In a preferred embodiment of one of the static mixing elements according to one of the first four aspects of the invention, the extensions in a direction transverse to a axis of said mixing channel of the mixing vanes which are axially arranged one after another overlap around said axis by an angle of between 30° to 90°.

A fifth aspect of the invention concerns a single stage static mixing element segment for mixing at least two components comprising a mixing channel of substantially tubular shape which is formed by at least two separate radial segments and wherein an inner wall of said mixing channel in radial direction forms an outer boundary of a cross section for receiving said components and at least one mixing vane arranged in said mixing channel.

Single stage means that this mixing element segment does not have mixing vanes which are arranged axially one after another. In case such a mixing element segment comprises several mixing vanes, these mixing vanes are arranged substantially on the same axial position.

In a preferred embodiment of the single stage mixing element segment, the mixing channel is formed by two radial segments each forming one half of said mixing channel.

Preferably, the single mixing vane is or the several mixing vanes are interconnected with the inner wall of the mixing channel by positive locking, by frictional connection (e.g. through clamping), by glueing or welding or by a combination thereof. It is, however, also planned to interconnect said mixing vanes with said inner wall by forming a vane and a part of the inner wall as a one-piece element.

A sixth aspect of the invention concerns a single stage static mixing element segment for mixing at least two components comprising a mixing channel of substantially tubular shape which is formed by a one-piece element and wherein an inner wall of said mixing channel in radial direction forms an outer boundary of a cross section for receiving said components and at least one mixing vane arranged in said mixing channel which is formed by at least one element which is separate from said mixing channel and which is interconnected with said inner wall of said mixing channel by positive locking and/or by frictional connection.

In a preferred embodiment of the fifth or the sixth aspect of the invention, the single stage static mixing element segment comprises at least two mixing vanes which are, preferably in the area of the center of the mixing channel, interconnected with each other for transferring axial forces to each other. Furthermore, it is preferred that the single stage mixing element segment of one of the two before mentioned aspects comprises exactly two mixing vanes which are symmetrically arranged around a central axis of the mixing channel.

The cross section of the before described single stage mixing element segments according to the fifth or the sixth aspect of the invention can have all shapes that have already been discussed for the static mixing element according to the first four aspects of the invention. The same applies for the possible extensions of the mixing vanes in the mixing channel. Furthermore, it is preferred that the mixing vanes are designed as swirl vanes.

Generally, for all the before mentioned aspects concerning static mixing elements or single stage static mixing element segments, it is planned to manufacture the mixing vanes and/or the part or the parts forming the mixing channel from plastics, preferably by injection moulding.

A seventh aspect of the invention concerns a static mixer comprising at least one static mixing element and/or at least one single stage static mixing element segment according to one of the preceding aspects of the invention.

Preferably, the static mixer comprises a housing for receiving said at least one static mixing element and/or said at least one single stage static mixing element segment.

In a preferred embodiment, the static mixer for mixing at least two components comprises a static mixing element having a mixing channel of substantially tubular shape which is undivided in axial direction and is formed by at least two separate radial segments and wherein an inner wall of said mixing channel in radial direction forms an outer boundary of a cross section for receiving said components and mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected with said inner wall for transferring axial forces to said mixing channel and a housing in which said static mixing element is arranged.

In another preferred embodiment, the static mixer for mixing at least two components comprises a static mixing element having a mixing channel of substantially tubular shape which is undivided in axial direction and is formed by at least two separate radial segments and wherein an inner wall of said mixing channel in radial direction forms an outer boundary of a cross section for receiving said components and mixing vanes arranged in said mixing channel which radially abut on said inner wall of said mixing channel and which are one-piece with at least one of said radial segments and wherein at least two of said mixing vanes are axially arranged one after another and wherein said mixing vanes of at least one of said radial segments preside over a split plane which is defined by radial split seams formed by said radial segment and a housing in which said static mixing element is arranged.

Preferably, the static mixer according to the seventh aspect further comprises an application nozzle.

An eighths aspect of the invention concerns a mixing vanes element for mixing at least two components, for arrangement in a mixing channel of substantially tubular shape which forms with an inner wall in radial direction an outer boundary of a cross section for receiving said components, comprising at least two mixing vanes which are in axial direction arranged one after another and wherein said mixing vanes which are arranged in axial direction one after another are, in an outer area, interconnected with each other through supporting pillars for transferring axial forces to each other.

In a preferred embodiment, said pillars are formed as one piece with said vanes which they interconnect. However, there are also embodiments planned at which individual pillars are affixed between said mixing vanes e.g. by glueing, welding or by stick-in connection, or at which the mixing vanes abut on and support each other through pillars formed by each of the individual mixing vanes.

In another preferred embodiment of the mixing vanes element, the mixing vanes which are arranged in axial direction one after another and/or which are arranged at the same axial position are interconnected with each other in the area of the center of said mixing vanes element for transferring axial forces to each other. By advantage, they are connected in such way that they form one piece in this area. By the before mentioned design, a mixing vanes element with a, in axial direction, quite sturdy structure is achieved which prevents, even at high flow forces like they are experienced when mixing very viscous goods or applying high flow rates, a deformation and a change in position of the mixing vanes. Both would affect the mixing quality. Even when using this mixing vanes element together with a conventional mixing channel, which merely provides a shoulder for axial abutment and support of the mixing vanes element at its outlet, good mixing results are achieved under the before mentioned conditions.

In a further preferred embodiment, the supporting pillars comprise means for effecting a positive locking situation with the inner wall of a mixing channel which receives the mixing vanes element. In combination with a suitable mixing channel this leads to an extremely stable arrangement.

Like with the before described static mixing elements, it is also preferred that the mixing vanes of this mixing vanes element are designed as swirl vanes, preferably with a different swirl direction of vanes which are arranged in axial direction one after another, and that the element is made of plastics, preferably manufactured through injection moulding.

A ninth aspect of the invention concerns a method for mixing very viscous components with the static mixing element, the single stage static mixing element segment, the static mixer or the mixing vanes element according to one of the preceding aspects of the invention.

In a preferred embodiment, the method for mixing very viscous polyurethane and a curing accelerating agent comprising the steps of providing a static mixing element having a mixing channel of substantially tubular shape which is undivided in axial direction and is formed by at least two separate radial segments and wherein an inner wall of said mixing channel in radial direction forms an outer boundary of a cross section for receiving said components and mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected with said inner wall for transferring axial forces from said second mixing vane to said mixing channel and effecting said polyurethane and said curing accelerating agent to simultaneously flow through said mixing channel of said static mixing element for mixing them.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 2A:
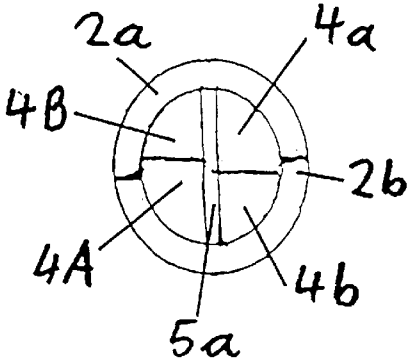
FIG. 2*a* is a view in flow direction on the static mixing element of FIG. 1.
Figure 1:
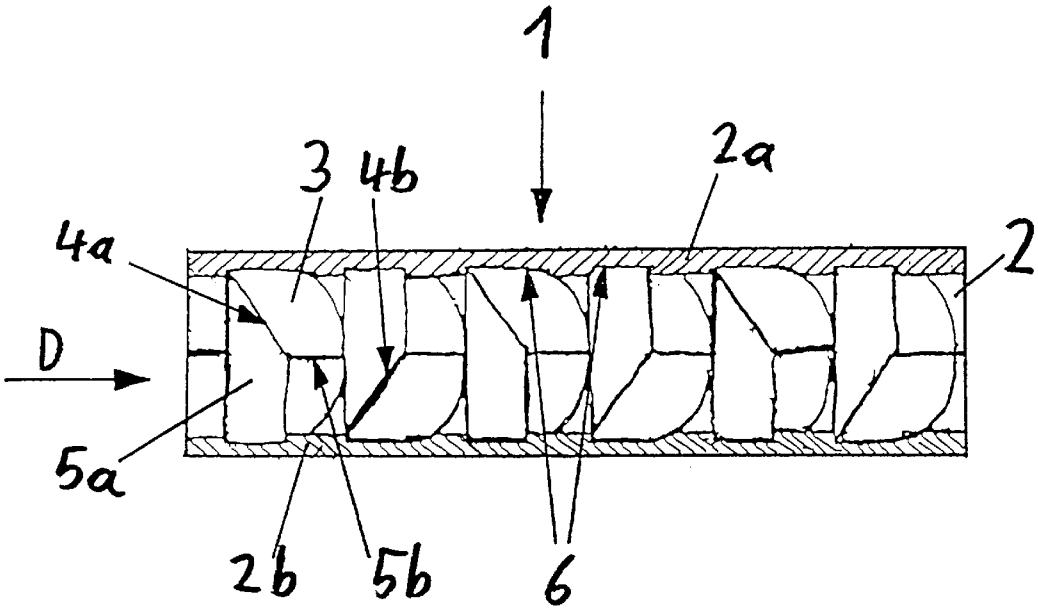
FIG. 1 is a partial sectional view of a static mixing element with a mixing channel formed by two radial segments.

The basic principle of a preferred embodiment of the invention is shown in FIG. 1. The static mixing element 1 shown in partial sectional view consists of a mixing channel 2 formed by two halves 2*a*, 2*b* (shown in sectional view) and a mixing vanes element 3 (shown in side view) with a multitude of mixing vanes 4*a*, 4A, 4*b*, 4B arranged within said mixing channel 2. The mixing vanes are interconnected with each other through being one-piece and are designed as swirl vanes 4*a*, 4A, 4*b*, 4B. They are arranged beside each other and in flow direction D axial one after another, whereby the swirl vanes 4*a*, 4A, 4*b*, 4B which are arranged one after another have opposite swirl directions. The mixing vanes element used here is a commercially available injection moulded plastics element which is manufactured in industrial scale. As can be seen in FIG. 2*a* which is a view in flow direction D on the static mixing element 1, there are arranged on each axial position two mixing vanes 4*a*, 4A which form pairs of mixing vanes 4*a* and 4A, 4*b* and 4B and whose ramps are separated by a separating wall 5*a*. Due to reasons of individual usability, the mixing vanes element 3 used in this example has an identical geometry in both axial directions, thus the backsides of the pairs of mixing vanes 4*a* and 4A, 4*b* and 4B also have ramps which are separated by a separating wall 5*b*. This separating wall 5*b* is turned, relatively to the separating wall 5*a* which is located at the front side of the pairs of mixing vanes 4*a* and 4A, 4*b* and 4B, by the angle of the extension of the mixing vanes 4*a*, 4A, 4*b*, 4B around a central axis of the mixing channel. This angle, in this case, is approx. 90°. The mixing vanes 4*a*, 4*b* resp. 4A, 4B, which are arranged axially one after another, have, in the shown example, practically no radial overlap. There is merely a slight offset of their edges due to the thickness of the separating wall 5*b*. Depending on the usage of the mixing elements, there are also other angles of extension of the mixing vanes 4*a*, 4A, 4*b*, 4B around a central axis of the mixing channel planned, e.g. bigger than 120° as well as around 180°. Furthermore, it is planned that the extensions around a central axis of the mixing channels 2 of mixing vanes 4*a*, 4*b* resp. 4A, 4B, which are arranged axially one after another, overlap, in particular by an angle in the range of 30° to 90°. The separating walls 5*a*, 5*b* form, in the area of the center of the mixing channel 2, a one-piece connection between those pairs of mixing vanes 4*a*, 4A and 4*b*, 4B which are, in flow direction D, arranged axially one after another. As can be seen as well in FIG. 2, the mixing channel 2 is formed by two halves 2*a*, 2*b* having axially oriented radial split seams. As can be seen in the sectional view of FIG. 1, these radial mixing channel segments 2*a*, 2*b*, which are designed as halves, have, arranged at their inner wall, pocket type recesses 6 which receive the outer contour of the mixing vanes 4*a*, 4A, 4*b*, 4B of the mixing vanes element 3. By this, a positive locking situation in axial direction between the mixing channel 2 and the mixing vanes element 3 is achieved. Such a design of the mixing channel 2 permits the formation of mixing elements 1 for very viscous goods, like e.g. pasty polyurethane and respective curing acceleration paste, and for high flow rates by using cost effective and commercially available mixing vanes elements 3.

Figure 2B:
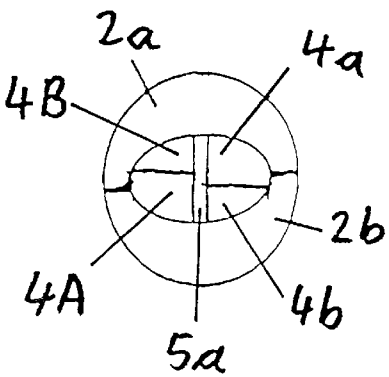
FIG. 2*b* is a view in flow direction on a static mixing element similar to the one of FIG. 1 having a non-circular mixing channel cross section.

FIG. 2*b* shows a view in flow direction on a mixing element having basically the same construction like the mixing elements 1 shown in the FIGS. 1 and 2*a*. The same mixing vanes element 3 as already shown before is interconnected with the mixing channel in the same manner as described before. In contrast to the examples shown before, the two halves 2*a*, 2*b* in this case form a mixing channel 2 having an oval cross section.

Figure 3:
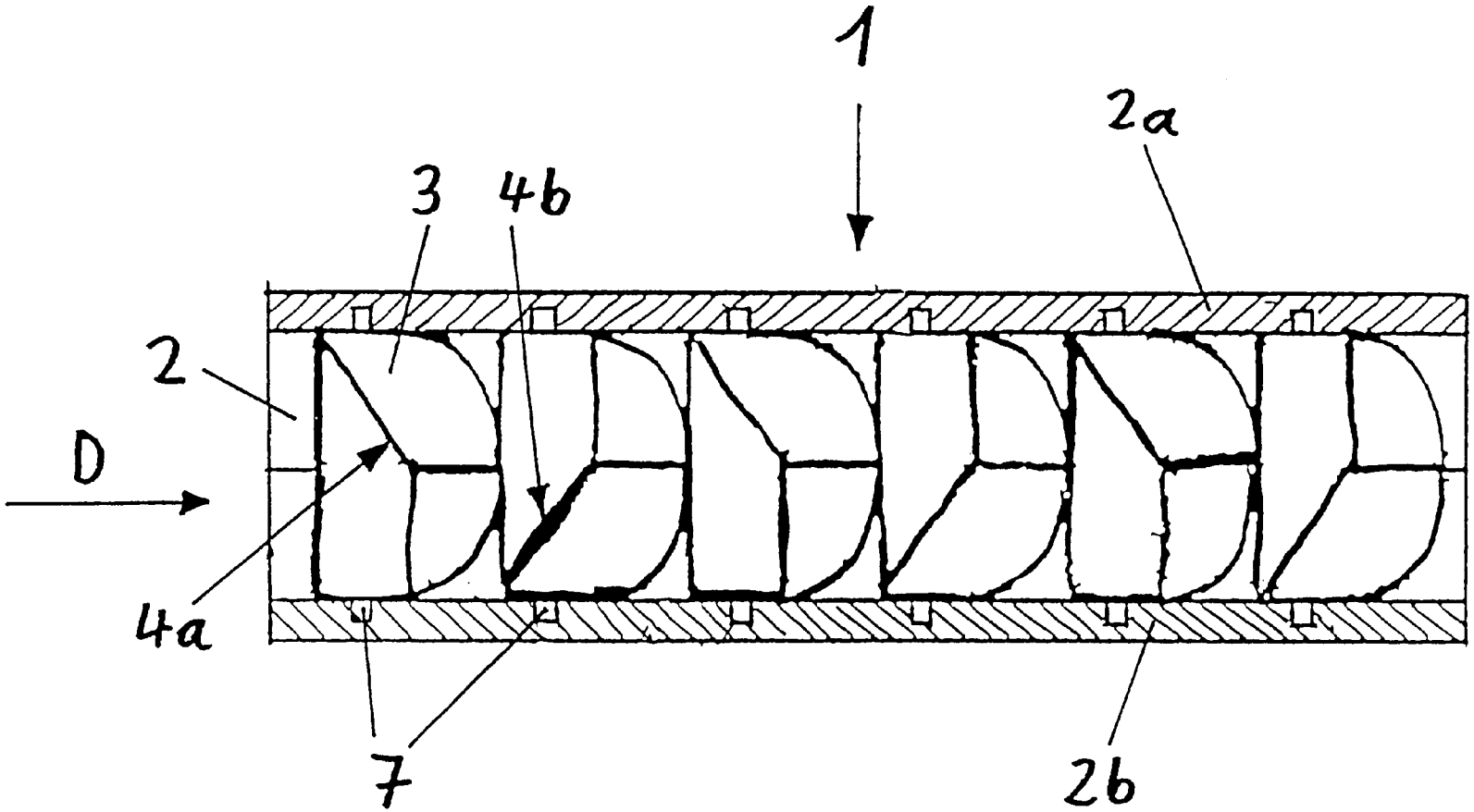
FIG. 3 is a partial sectional view of another static mixing element with a mixing channel formed by two radial segments.

The mixing element 1 shown in FIG. 3, which has a radially split mixing channel 2, uses a mixing vanes element 3 which comprises, in the outer area of its mixing vanes 4*a*, 4A, 4*b*, 4B, protrusions 7 which protrude in respective recesses in the inner wall of the mixing channel halves 2*a*, 2*b*. In the shown example, these protrusions 7 are cylindrical pins which are one-piece with the mixing vanes 4*a*, 4A, 4*b*, 4B and which protrude in respective blind holes in the inner wall of the mixing channel halves 2*a*, 2*b*. Even though in the examples the mixing vanes 4*a*, 4A, 4*b*, 4B protrude into recesses in the mixer wall 2 for effecting a positive locking situation, there are also embodiments planned at which the inner wall of the mixing channel comprises protrusions which protrude into recesses in the mixing vanes 4*a*, 4A, 4*b*, 4B. Furthermore combinations of both are planned.

Figure 4:
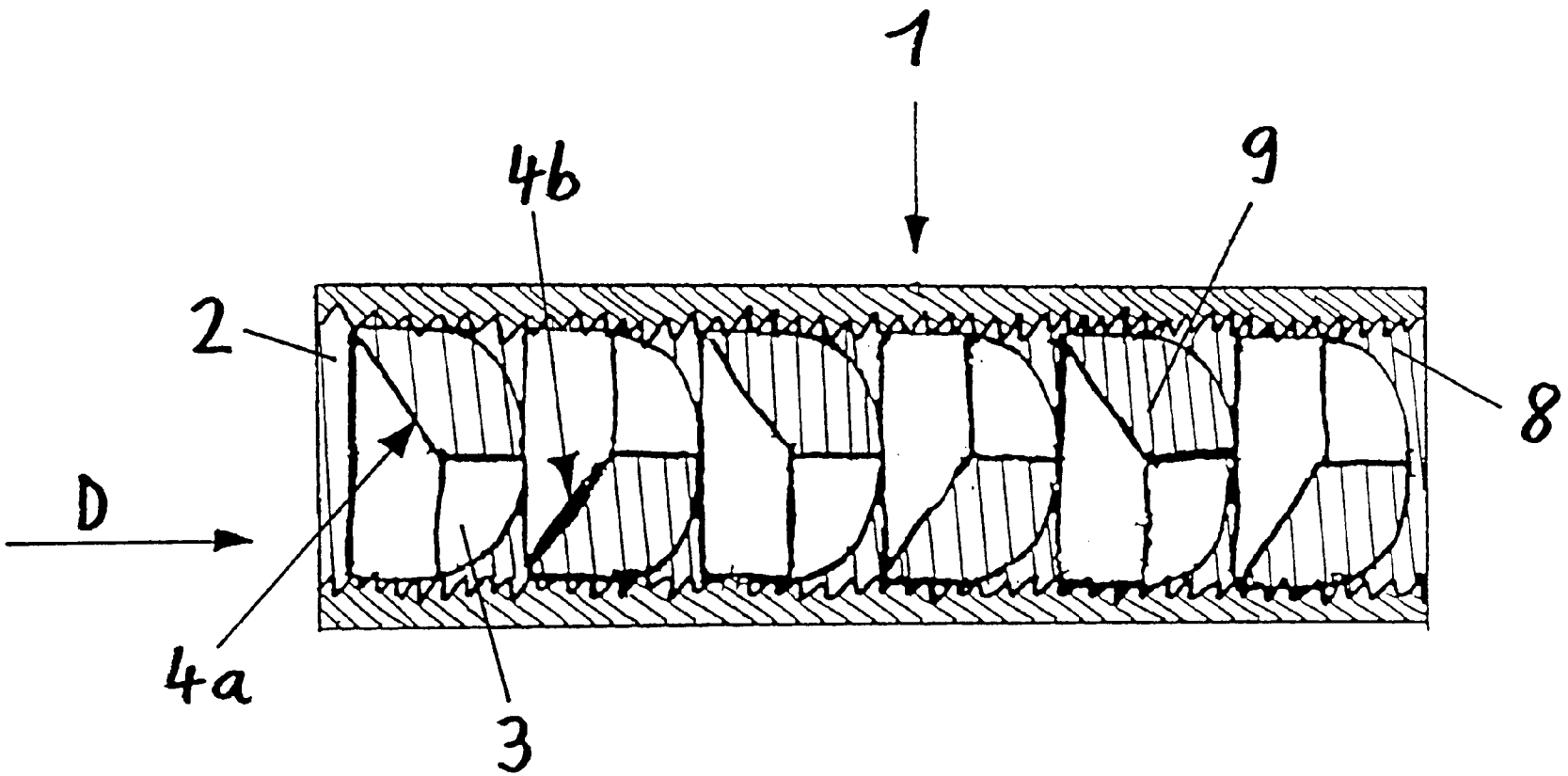
FIG. 4 is a partial sectional view of a static mixing element with a one-piece mixing channel.

In case the mixing channel 2 is designed as a one piece element, a positive locking situation between mixing channel 2 and mixing vanes element 3 can, by advantage, be achieved through equipping the mixing channel 2 at its inner wall with an inner thread 8 and the mixing vanes 4*a*, 4A, 4*b*, 4B or the mixing vanes element 3 at the outer surface with a respective outer thread 9. Such an embodiment is shown in FIG. 4. Furthermore it is planned to use, instead of a thread, a bayonet like connection between these elements, e.g. protruding noses arranged at the outer surface of the mixing vanes 4*a*, 4A, 4*b*, 4B which effect a positive locking situation with notches arranged in the mixing channel 2.

Figure 5:
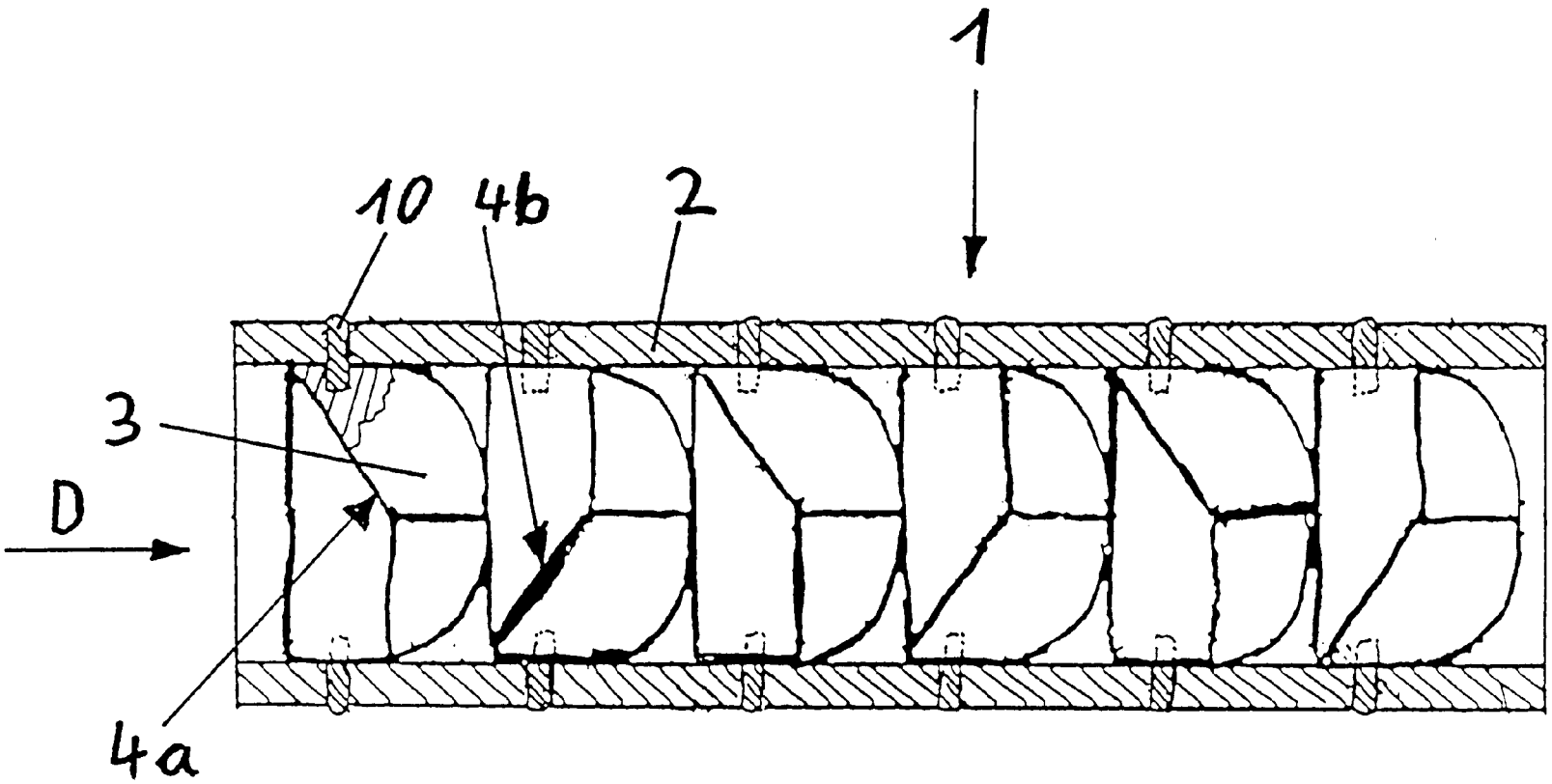
FIG. 5 is a partial sectional view of another static mixing element with a one-piece mixing channel.

As is shown in FIG. 5, the positive locking situation can furthermore be generated through additional elements like, for example, metal pins 10 which radially penetrate the wall of the mixing channel 2 and protrude in respective holes in the mixing vanes 4*a*, 4A, 4*b*, 4B of the mixing vanes element 3.

Figure 6:
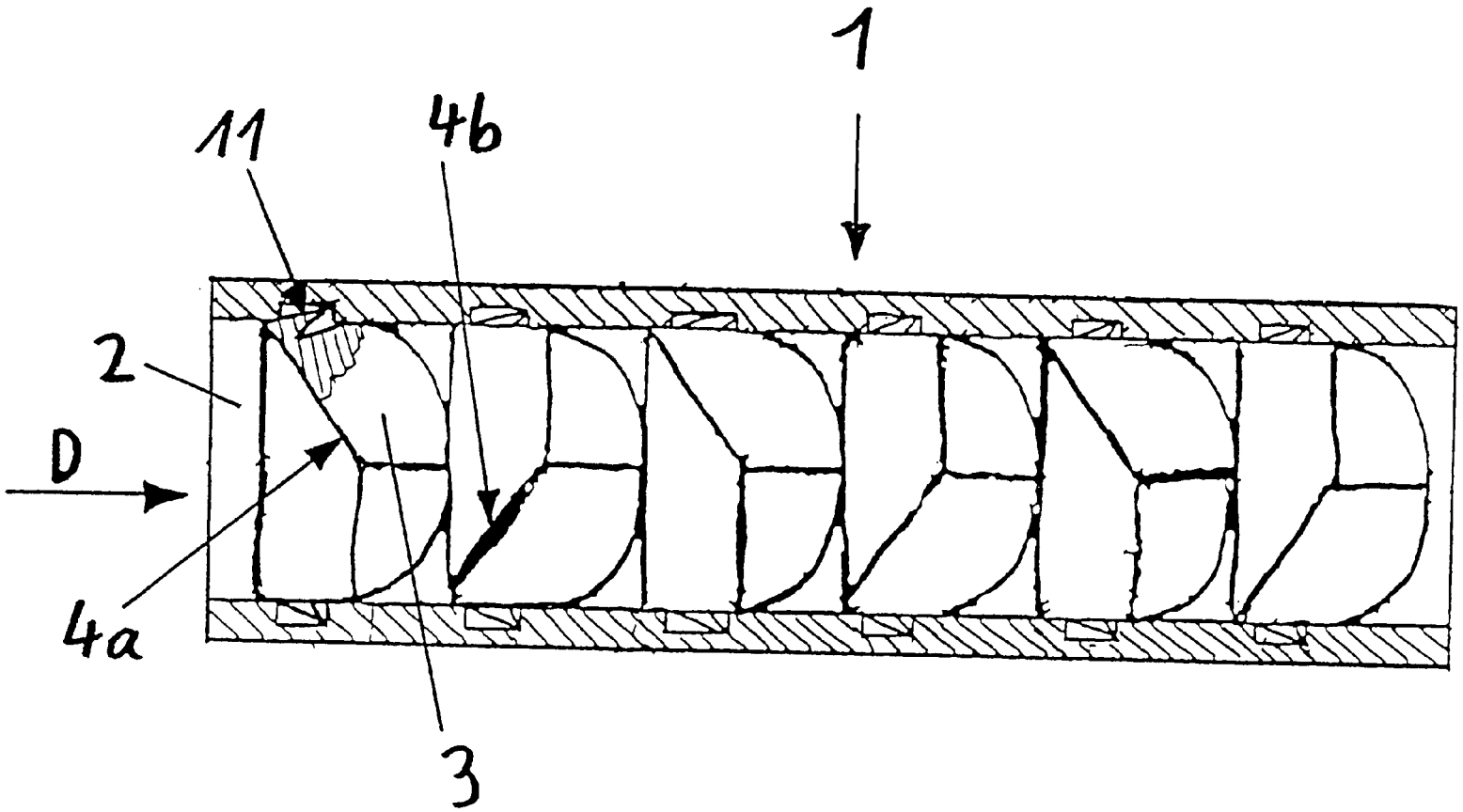
FIG. 6 is a partial sectional view of still another static mixing element with a one-piece mixing channel.

A further preferred embodiment is shown in FIG. 6. In this embodiment, a positive locking situation between mixing channel 2 and mixing vanes element 3 is achieved by snap-in of noses 11, which are arranged at the mixing vanes 4*a*, 4A, 4*b*, 4B of the mixing vanes element 3 and which are resilient in radial direction, into suitable recesses in the inner wall of the mixing channel 2. As can be seen in the drawing, the mixing vanes element 3 can, under resilient radial bending of the noses 11, be introduced into the mixing channel 2 in a direction opposite to the flow direction D. After the mixing vanes element 3 has reached its designated position in the mixing channel 2, the noses 11 snap-in into recesses, like e.g. notches in the inner wall of the mixing channel 2, and prevent through positive locking an axial movement of the mixing vanes element 3 in the mixing channel 2 in flow direction D. Beside the design shown, it is, for example, also planned to adapt the mixing vanes element 3 in such way that the individual mixing vanes 4*a*, 4A, 4*b*, 4B themselves form such, in radial direction resilient, noses which resiliently slant in radial direction when said mixing vanes element 3 is introduced into the mixing channel 2 against flow direction D and which, after engagement with respective recesses in the inner wall of the mixing channel 2, ensure, when axial forces in flow direction are applied, a positive locking situation, whereby they, if necessary, in addition radially straddle in the mixing channel 2.

Figure 7:
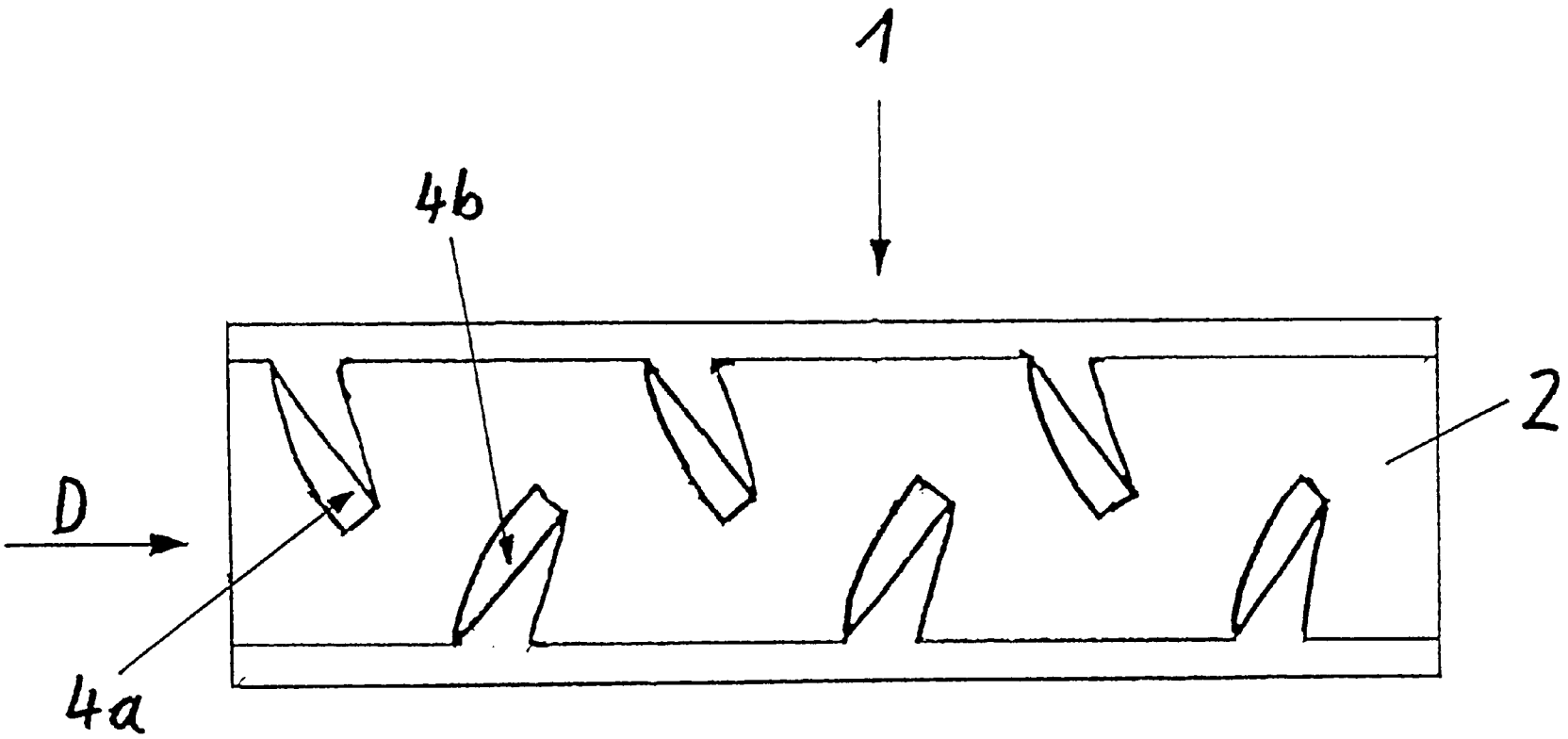
FIG. 7 is a side view on the inside of one of the two halves of the mixing channel of a radially split mixing element having mixing vanes that are one piece with the mixing channel halves.

FIG. 7 shows one radial segments 2 which together with a second radial segment form a radially split mixing element 1. The shown segment forms one half of the mixing channel 2 resp. of the mixing element 1 and comprises mixing vanes 4*a*, 4*b* arranged at its side which forms the inner wall of the mixing channel 2. These mixing vanes are one-piece with said segment 2. Furthermore, these mixing vanes 4*a*, 4*b* are, as already the mixing vanes in the preceding examples, designed as swirl vanes. The second half in this case can be identical to the shown half, thus it is possible to compose from two identical elements in a very cost effective manner a mixing element according to the invention. In the shown case, the mixing vanes are free-standing mixing vanes 4*a*, 4*b*, however it is also planned that mixing vanes 4*a*, 4*b* which are arranged axially one after another and/or mixing vanes 4*a*, 4A which are arranged at the same axial position are interconnected with each other in a central area of the mixing channel 2. In particular, it is planned that these vanes are interconnected by being one piece or by positive locking. Furthermore, it is of advantage if the mixing vanes 4*a*, 4A, 4*b*, 4B of the individual segments which form the mixing channel 2 are interconnected with each other through positive locking in axial direction, e.g. in the fashion of intersecting tines formed by the tips of the mixing vanes. The mixing vanes 4*a*, 4A, 4*b*, 4B of mixing elements of this type can extend around a central axis of the mixing channel 2 resp. the extensions in a direction transverse to the axis of the mixing element of mixing vanes 4*a*, 4*b* which are arranged axially one after another can overlap in the same way as in the before shown cases of a mixing elements having mixing vanes which are separate from the mixing channel.

Figure 8:
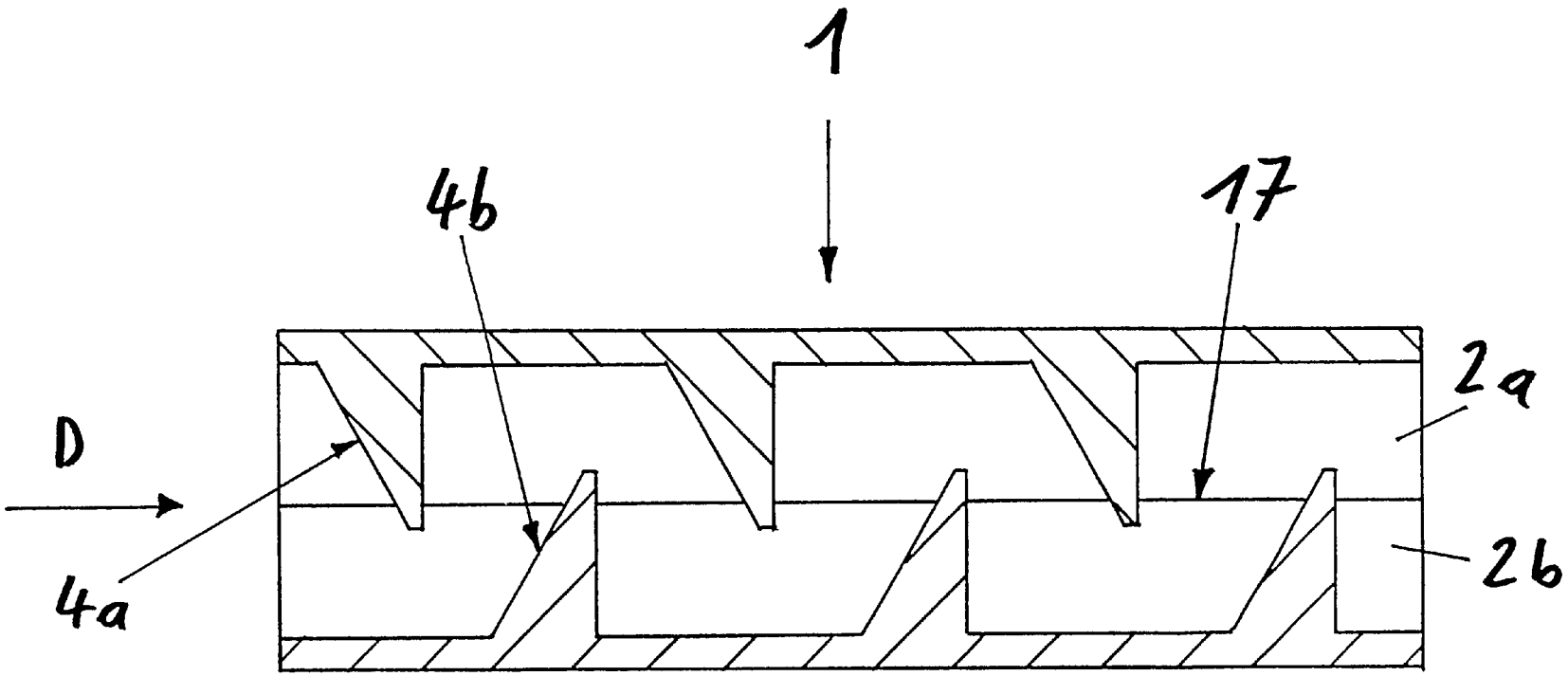
FIG. 8 is a sectional view of a mixing element formed by two halves with a square mixing channel cross section and mixing vanes which are one piece with the two halves.

FIG. 8 shows a sectional view of a mixing element 1 whose mixing channel is formed by two radial segments. In particular, the shown mixing element 1 is formed by two halves 2*a*, 2*b* and has a square cross section. As can clearly be seen, the mixing vanes 4*a*, 4*b* are one piece with the inner walls of the halves 2*a*, 2*b* and preside over the split plane which is defined by the radial split seams 17 which are formed by the two halves 2*a*, 2*b* (due to the sectional view only one split seam visible) and extends into the area of the opposite half 2*a*, 2*b*.

Figure 9:
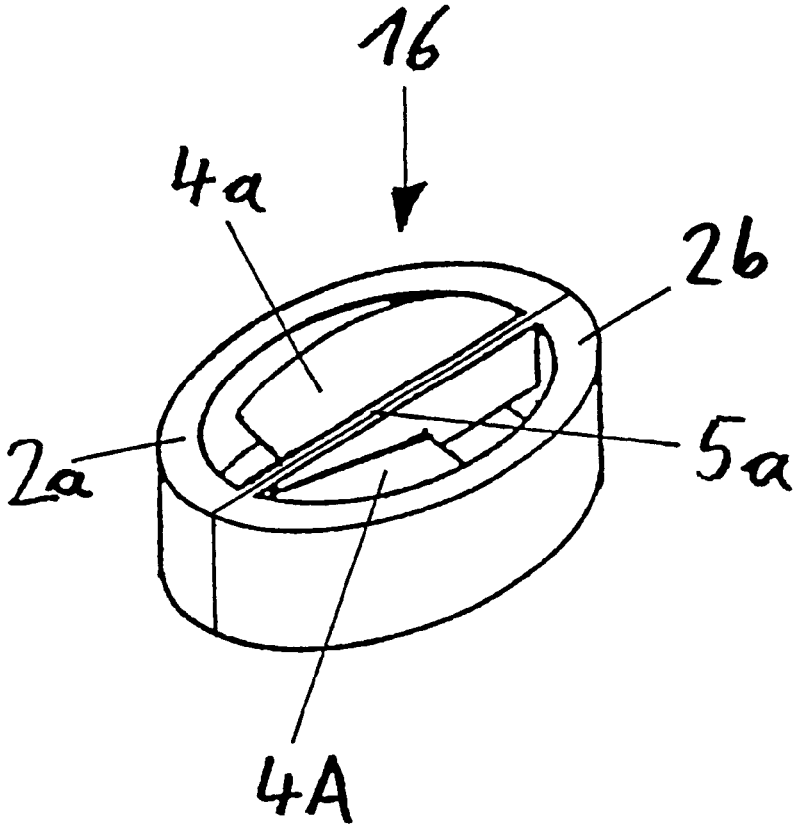
FIG. 9 is a view of a single stage static mixing element segment with a mixing channel formed by two halves and two mixing vanes each formed as one piece with one of said halves.

FIG. 9 shows a view of a single stage static mixing element segment 16 having two mixing vanes 4*a*, 4A which are designed as swirl vanes. The mixing vanes 4*a*, 4A are symmetrically arranged in the mixing channel 2*a*, 2*b* around a central axis of said mixing channel. The ramps of the mixing vanes 4*a*, 4A are separated by a separating wall 5*a*. In the shown case, the mixing channel is formed by two halves 2*a*, 2*b* which each are one-piece with one of the mixing vanes 4*a*, 4A and a half of the separating wall 5*a*.

Figure 10:
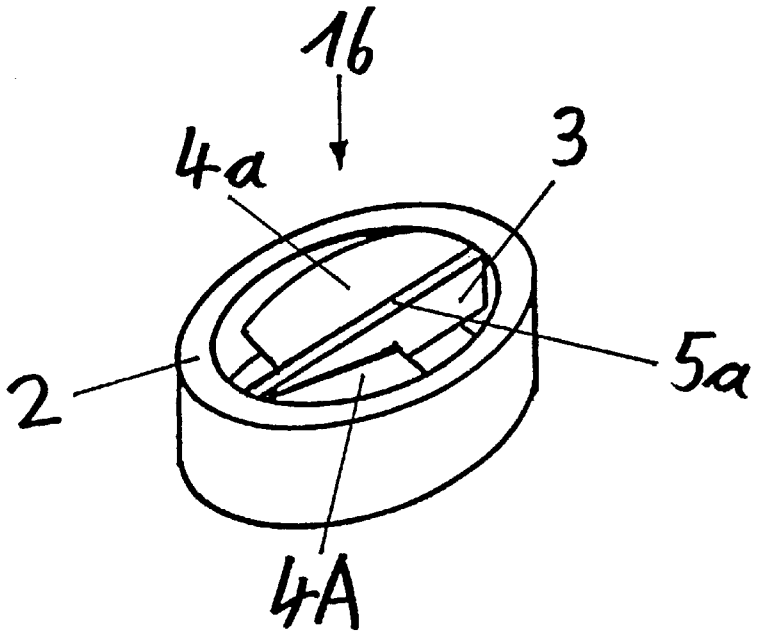
FIG. 10 is a view of a single stage static mixing element segment with a mixing channel formed by a one-piece element and mixing vanes formed by a separate element.
Figure 11:
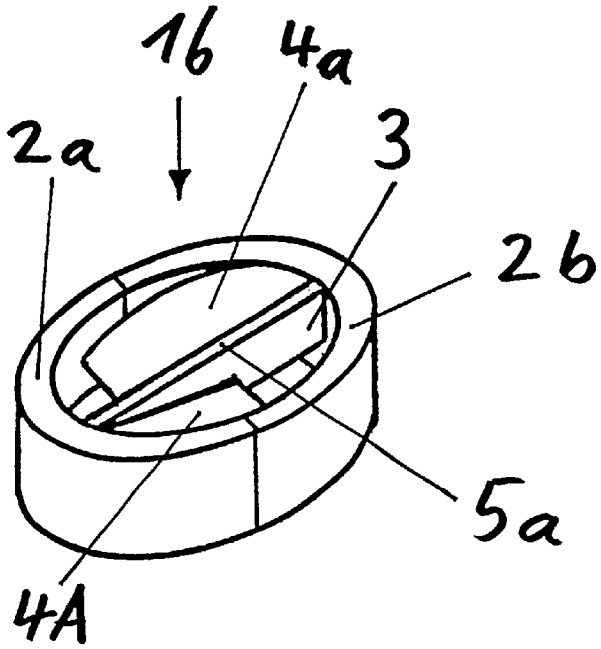
FIG. 11 is a view of a single stage static mixing element segment with a mixing channel formed by two halves and mixing vanes formed by a separate element.

The FIGS. 10 and 11 each show a single stage static mixing element segment 16 having a similar geometry like the one shown in FIG. 9, however with mixing vanes 4*a*, 4A which are separate from the mixing channel 2, 2*a*, 2*b*. In both cases, the mixing vanes 4*a*, 4A are formed by a separate one-piece mixing vanes element 3. While the mixing channel 2 of the single stage static mixing element segment 16 shown in FIG. 10 is of one-piece design, it consists in case of the single stage static mixing element segment shown in FIG. 11 of two halves 2*a* and 2*b* which enclose the mixing vanes element 3. The interconnection between the inner wall of the mixing channel 2, 2*a*, 2*b* and the mixing vanes 4*a*, 4A resp. the mixing vanes element 3 can be achieved by one of the before described positive locking and/or frictional connection solutions.

Figure 12:
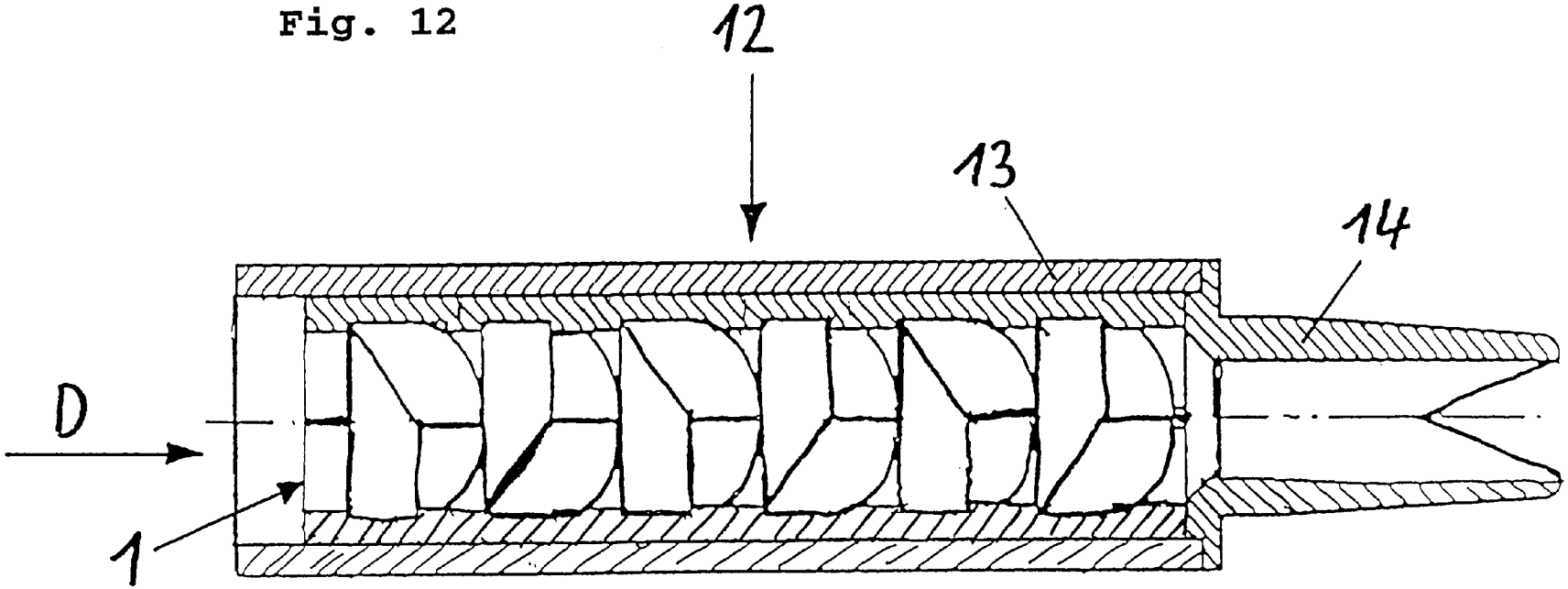
FIG. 12 is a partial sectional view of a static mixer with the static mixing element of FIG. 1.

FIG. 12 shows a static mixer 12 having a static mixing element 1 according to FIG. 1 arranged in a housing 13. In the area of the exit of the mixing element 1, an application nozzle 14 is arranged which eases the selective application of the stream of mixed components leaving said mixer 12. Even though the static mixer 12 is shown with only one mixing element 1, there are also embodiments planned which have several mixing elements 1, in particular several mixing elements 1 which are axially arranged one after another. Furthermore, embodiments are planned in which several single stage static mixing element segments are arranged axially one after another. Moreover there are static mixers 12 planned which comprise mixing elements 1 as well as single stage static mixing element segments 16.

Figure 13:
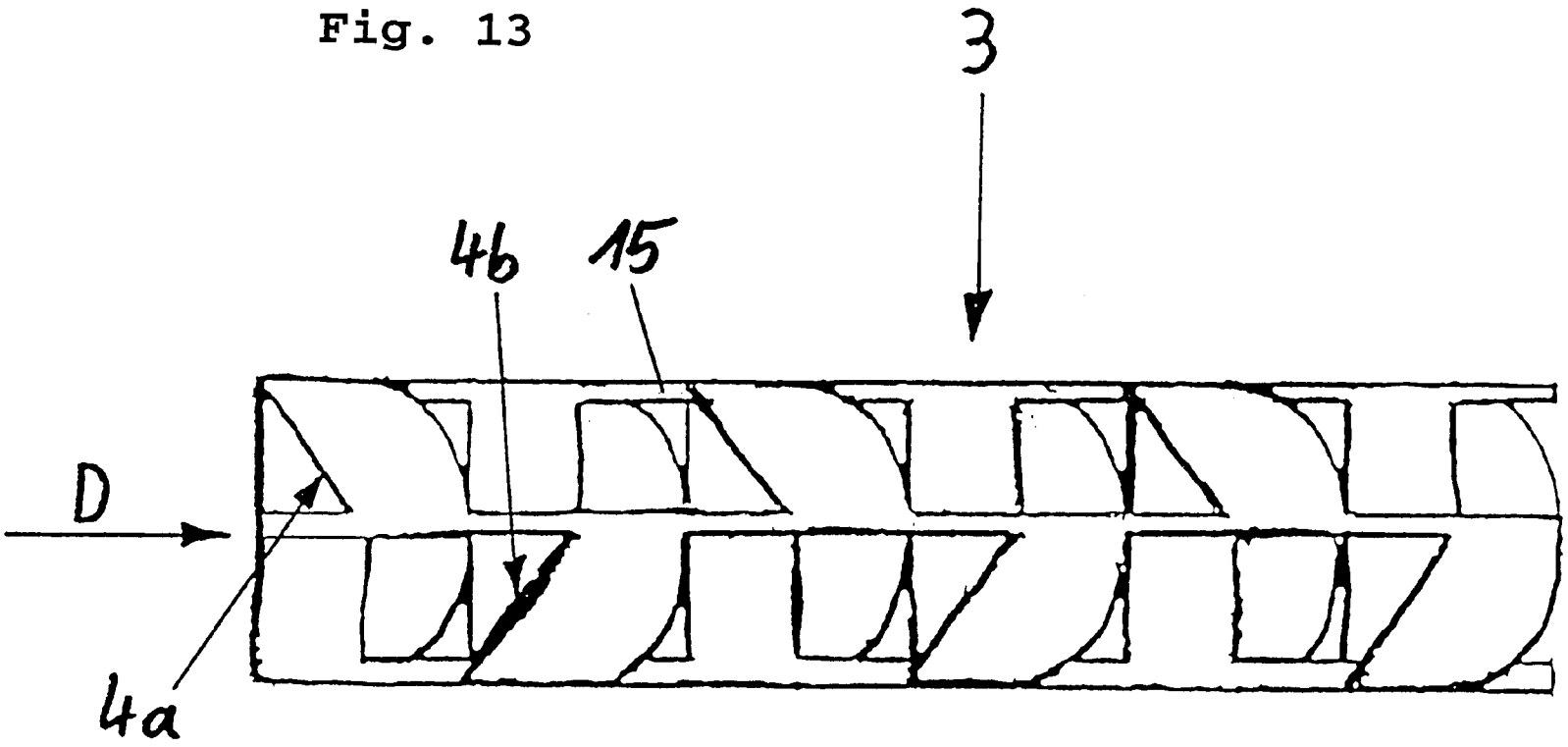
FIG. 13 is a side view of a mixing vanes element having in its outer area arranged between its mixing vanes supporting pillars.

FIG. 13 shows a mixing vanes element 3 having arranged in the outer area between the mixing vanes 4*a*, 4*b* supporting pillars 15. The mixing vanes 4*a*, 4*b* of the shown mixing vanes element 3 are designed as swirl vanes 4*a*, 4*b*.

While there are shown and described presently preferred embodiments of the invention, it is to be distinctly understood that the invention is not limited thereto but may be otherwise variously embodied and practiced within the scope of the following claims.

What is claimed is:

1. A static mixing element for mixing at least two components, comprising:

a) a mixing channel of substantially tubular shape which is undivided in axial direction and is formed by at least two separate radial segments and wherein an inner wall of said mixing channel in radial direction forms an outer boundary of a cross section for receiving said components; and b) mixing vanes arranged in said mixing channel which radially abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected with said inner wall for transferring axial forces to said mixing channel by protruding into a recess in said inner wall of said mixing channel, wherein said recess substantially has the shape of said mixing vanes in said area.

2. The static mixing element of claim 1, wherein said mixing channel is formed by two radial segments which each form one half of said mixing channel.

3. The static mixing element of claim 1, further comprising one or several additional elements to cause a positive locking situation between said at least one second mixing vane which is interconnected with said inner wall of said mixing channel and said inner wall of said mixing channel.

4. The static mixing element of claim 3, wherein said additional elements are pins.

5. The static mixing element of claim 1, wherein said at least one second mixing vane which is interconnected with said inner wall of said mixing channel is arranged axially in flow direction at the first position.

6. The static mixing element of claim 1, wherein at least two mixing vanes which are in axial direction arranged one after another are, in said area where they radially abut on said inner wall of said mixing channel, interconnected with said inner wall.

7. The static mixing element of claim 1, wherein mixing vanes which are arranged in axial direction one after another and/or at the same axial position are interconnected with each other for transferring axial forces to each other.

8. The static mixing element of claim 7, wherein said mixing vanes, which are arranged in axial direction one after another and/or at the same axial position are interconnected with each other in a central area of said mixing channel.

9. The static mixing element of claim 1, wherein at least two mixing vanes form an one-piece mixing vanes element.

10. The static mixing element of claim 9, wherein said mixing vanes element comprises at least two mixing vanes arranged in axial direction one after another.

11. The static mixing element of claim 10, wherein said at least two mixing vanes of said mixing vanes element which are arranged in axial direction one after another are, in said area in which they abut on the inner wall of said mixing channel, interconnected with each other through supporting pillars.

12. The static mixing element of claim 11, wherein said supporting pillars are arranged in radial recesses in said inner wall of said mixing channel.

13. The static mixing element of claim 9, comprising at least two of said mixing vanes elements.

14. The static mixing element of claim 1, wherein extensions of mixing vanes, which are axially arranged one after another, in a direction transverse to an axis of said mixing element overlap around a central axis of said mixing channel by an angle of between 30° and 90°.

15. The static mixing element of claim 1, wherein said mixing channel has a non-circular or a substantially angular cross-section.

16. The static mixing element of claim 1, wherein said mixing vanes and/or said mixing channel are made of plastics.

17. A static mixer for mixing at least two components comprising:

A) a static mixing element having c) a mixing channel of substantially tubular shape which is undivided in axial direction and is formed by at least two separate radial segments and wherein an inner wall of said mixing channel in radial direction forms an outer boundary of a cross section for receiving said components; and d) mixing vanes arranged in said mixing channel which radically abut on said inner wall of said mixing channel and which are formed by at least one element which is separate from said mixing channel, wherein said mixing vanes comprise a last mixing vane which is arranged axially in flow direction at a last position of said mixing vanes and at least one second mixing vane which is arranged axially in flow direction before said last mixing vane, and wherein at least one of said at least one second mixing vane is, in an area where it radially abuts on said inner wall of said mixing channel, interconnected with said inner wall for transferring axial forces to said mixing channel by protruding into a recess in said inner wall of said mixing channel, wherein said recess substantially has the shape of said mixing vanes in said area, and B) a housing in which said static mixing element is arranged.

18. The static mixer of claim 17, further comprising an application nozzle.

* * * * *